US005078539A

United States Patent [19]

Claing

[11] Patent Number: 5,078,539

[45] Date of Patent: Jan. 7, 1992

[54] BENDABLE RAISING STRUCTURE FOR MANHOLE COVER WITH PREDETERMINED WEAK SPOT

[76] Inventor: Jean-Louis Claing, 337, rue Principale, St-Bernard de Michaudville, Quebec, Canada, J0H 1C0

[21] Appl. No.: 669,104

[22] Filed: Mar. 13, 1991

[51] Int. Cl.[5] ..... E02D 29/14

[52] U.S. Cl. ..... 404/26; 404/25

[58] Field of Search ..... 404/25, 26

[56] References Cited

U.S. PATENT DOCUMENTS

| | | | |
|---|---|---|---|
| 3,926,533 | 12/1975 | Binette | 404/26 |
| 4,475,845 | 10/1984 | Odill et al. | 404/25 |
| 4,872,780 | 10/1989 | Bowman | 404/26 |
| 4,963,053 | 10/1990 | Bowman | 404/26 |
| 4,995,757 | 2/1991 | Prescott | 404/25 X |

*Primary Examiner*—Ramon S. Britts
*Assistant Examiner*—Nancy P. Connolly
*Attorney, Agent, or Firm*—Roland L. Morneau

[57] ABSTRACT

The raising structure according to the invention is intended to raise a manhole cover to the level of the resurfacing new layer of asphalt. The raising structure comprises a pair of superposed concentric rings one of which is slightly smaller than the other one so that the outer diameter of the smaller one is slightly smaller than the inner diameter of the other one. The rings are maintained in a spaced relationship by a set of spacer legs disposed around the periphery of the inner ring. Each of the legs have one end secured to the outer periphery of the small ring and the outer end of the leg is secured to the inner periphery of the larger ring. The legs are characterized by at least one bent section between both ends of the legs. The bent section extends in a plane tangent to the outer periphery of the smaller ring and the inner periphery of the larger ring. The bent section is adapted to define a weak section in the legs for allowing a change in the angle of the bent upon pressure on one of the rings.

5 Claims, 3 Drawing Sheets

BENDABLE RAISING STRUCTURE FOR MANHOLE COVER WITH PREDETERMINED WEAK SPOT

FIELD OF THE INVENTION

This invention relates to manholes such as the ones used to drain pavements or to access service infrastructural networks underneath the pavement, and more particularly to a supporting structure which allows raising of the manhole cover prior to resurfacing operations on the surrounding pavement.

BACKGROUND OF THE INVENTION

In most residential and industrial areas, some services make use of infrastructural networks such as telephone wires, heating gas pipelines and sewage ducts which run underneath the paved surfaces.

These networks require wells commonly referred to as manholes which allow both drainage of the surface and access to the infrastructural for inspection and maintenance operations.

Conventional manholes have a cover closing off their upper portion. The cover typically rests on an annular leveling base.

The cast iron frame has an annular recess adapted to support the base surface of the cover and to form a rim around the peripheral surface of the cover. During the initial paving operations of the surface surrounding the manhole, the supporting frame is positioned of top of the leveling base and asphalt is poured around the frame until the freshly covered pavement is level with the upper surface of the rim. Once the asphalt is dry, the upper surface of the rim, the upper surface of the cover and the pavement are all of the same level.

As the pavement periodically becomes worned out by the passage of vehicles and changes in temperature, it is customary to repair the damages by covering the old surface with a new layer of asphalt.

When such an operation is performed, it becomes necessary to raise the manhole cover to the level of the newly covered surface. Instead of completely rebuilding the concrete leveling base, it is common practice to use a raising structure positioned on the cover at the level of the new layer of asphalt.

These raising structures are also adapted to compensate the manufacturing defaults and normal wear which cause the upper surface of the cover to deform and to deviate from an horizontal plane even if the base of the cover is horizontal.

When the upper surface of the cover is no longer horizontal it is imperative that the rim which surrounds the cover be adjusted so that the upper surface of the rim is flush with the upper surface of the cover, all around its periphery. If a portion of the upper surface of the cover is not flush with the upper surface of the rim, the cover which sits on an horizontal support will tilt upon passage of vehicles. The resulting movement of the cover will cause additional wear to its structure and create a noisy interaction with the rim.

The conventional raising structure consists of an annular base ring and a top annular ring kept in vertically spaced relationship by independant spacing legs. The base annular ring and a top annular ring have respectively an outer and an inner diameter substantially corresponding to the outer diameter of the cover. The base annular ring is adapted to sit on the conventional cast iron supporting frame instead of the cover and the cover to rest on the top annular ring. During the resurfacing operations, once the raising structure is positioned on the conventional cast iron supporting frame, and the cover is placed on the base annular ring, the new layer of asphalt is poured until it is substantially level with the top surface of the cover. The length of the spacing legs is such that the upper surface of the rim exceeds the height of the cover. The spacing legs consists of rectangular or substantially parallelogram-shaped tongues of metal, the upper edge of the tongue being welded to the top annular ring and the bottom of the tongue being welded to the base annular ring. The tongues are relatively thin and adapted to crease.

When the compacting roller passes over the portion of the rim exceeding the top surface of the cover, each leg is adapted to bend randomly and generally in a plane perpendicular to the largest side of the parallelogram until the rim becomes flush with the upper surface of the cover all around its periphery, thus compensating for structural defects on the upper surface of the cover.

One of the major drawbacks of conventional structures is inherent to the fact that the legs which bend randomly and sideways abut against the cover once they are bent. This random bending action can also cause a vertical misalignement between the top and base annular rings. To circumvent the above mentioned disadvantages, the present invention uses spacing legs having a predetermined weakness plane.

SUMMARY OF THE INVENTION

The raising structure according to the invention is intended to raise a manhole cover to the level of the resurfacing new layer of asphalt. The raising structure comprises a pair of superposed concentric rings one of which is slightly smaller than the other one so that the outer diameter of the smaller one is slightly smaller than the inner diameter of the other one. The rings are maintained in a spaced relationship by a set of spacer legs disposed around the periphery of the inner ring. Each of the legs have one end secured to the outer periphery of the small ring and the other end of the leg is secured to the inner periphery of the larger ring. The legs are characterized by at least one bent section between both ends of the legs. The bent section extends in a plane tangent to the outer periphery of the smaller ring and the inner periphery of the larger ring. The bent section is adapted to define a weak section in the legs for allowing a change in the angle of the bent upon pressure on one of the rings.

DETAILED DESCRIPTION OF THE INVENTION

Figure 1:
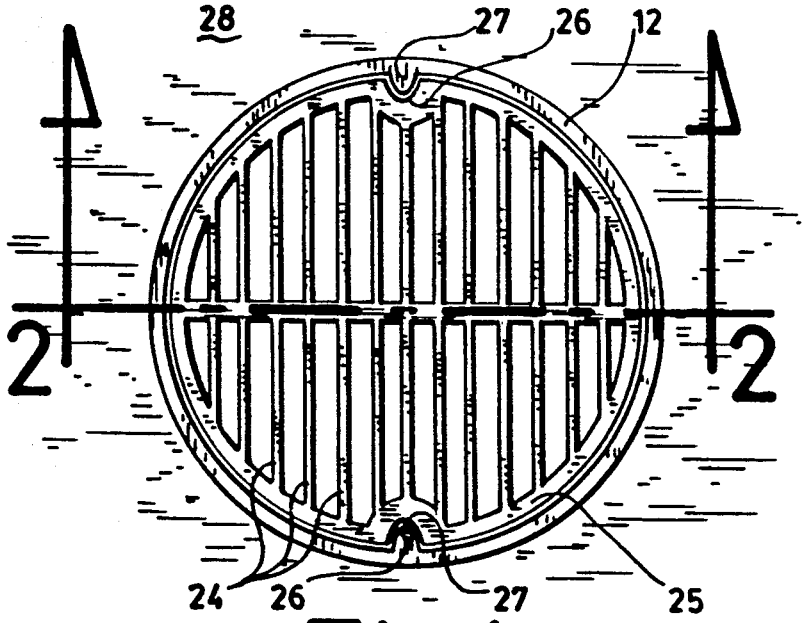
Fig.1 (PRIOR ART)
FIG. 1 is a top view of a conventional manhole.
Figure 2:
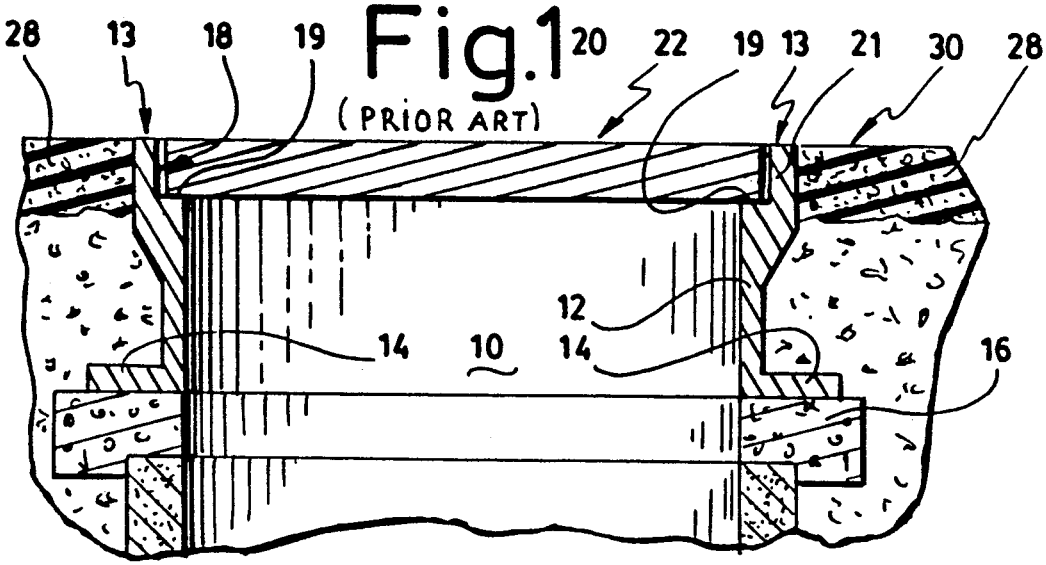
Fig.2 (PRIOR ART)
FIG. 2 is a cross-sectional view of a conventional manhole taken along line 2—2 of FIG. 1.

Referring more specifically to FIG. 2, there is shown an upper portion of a manhole 10 consisting of an annular cast iron supporting frame 12 having stabilizing flange 14 which sit on an annular concrete leveling base 16. The supporting frame 12 has top surface 13 and is provided with an annular recess 18 adapted to receive a cover 20 having a top surface 22. The annular recess 18 has a substantially horizontal peripheral surface 19 on which the cover 20 is supported and an upper section adapted to form a rim 21 around the cover 20. As shown in FIG. 1, the cover 20 consists of a set of ribs 24 integrally formed with a peripheral frame 25. The peripheral frame 25 is provided with a pair of indentations 26 adapted to receive a corresponding pair of prongs 27 formed integral with the supporting frame 12 to prevent rotation of the cover 20. During initial installation of the conventional manhole structure, a layer of asphalt 28 is poured around the rim 21 until the top surface 30 of the layer 28 reaches the same level as the top surface 13 of the supporting frame 12.

Figure 3:
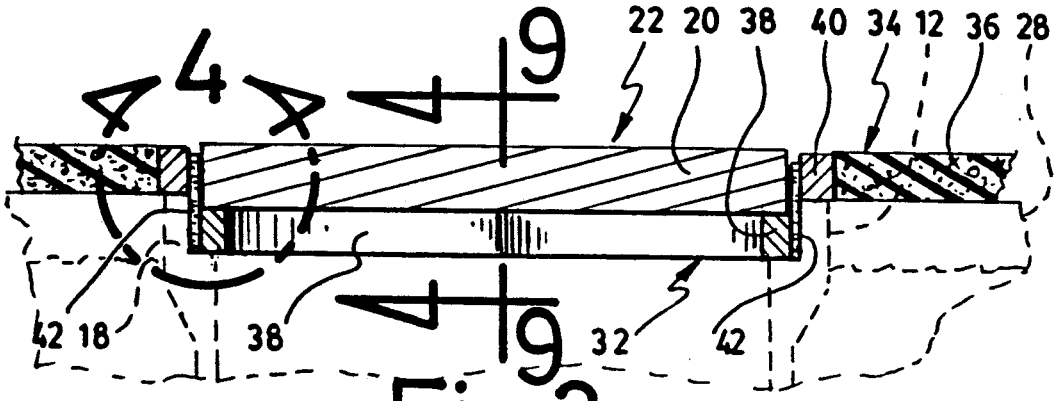
FIG. 3 is a cross-sectional view of a manhole having its cover raised by the raising structure according to the invention.

Referring to FIG. 3, there is shown a raising structure 32 embodying the invention adapted to support the cover 20 so that the upper surface 22 of the cover is level with the top surface 34 of a new layer of asphalt 36 having a thickness A.

Figure 7:
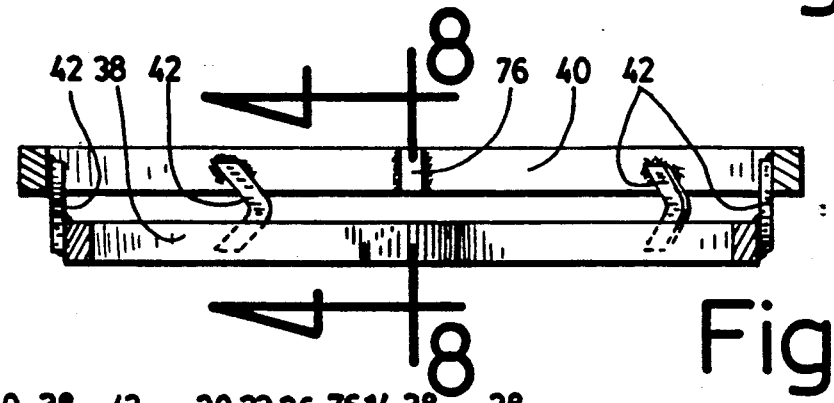
FIG. 7 is a cross-sectional view taken along line 7—7 of FIG. 6.
Figure 9:
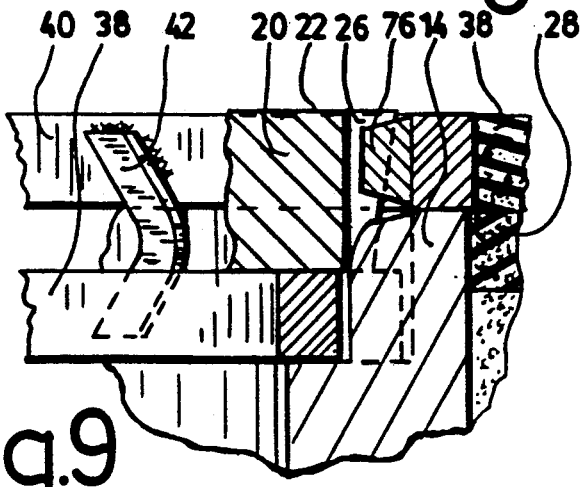
FIG. 9 is a cross-sectional view of the structure along line 9—9 of FIG. 3.
Figure 8:
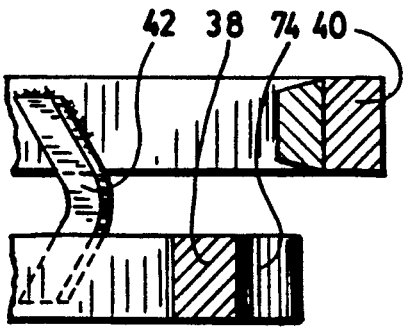
FIG. 8 is a cross-sectional view taken along line 8—8 of FIG. 7.

The raising structure 32 has a base ring 38 and a top ring 40 kept in vertically spaced relationship by a set of independent spacing legs 42 (see FIG. 7). The base ring 38 has an outside diameter 44 substantially corresponding to the diameter of the cover 20 and to the inner diameter of the top ring 40.

The base ring 38 is adapted to sit in the annular recess 18 of the supporting frame 12 instead of the cover 20. The cover 20 is adapted to rest on the base ring 38.

Figure 4:
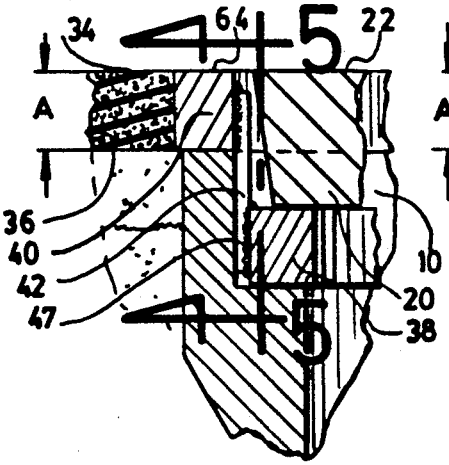
FIG. 4 is an enlarged detailed view taken inside arrows 4 of FIG. 3.

As illustrated in FIG. 4, the spacing legs 42 are rigidly attached to both the base ring 38 and the top ring 40 by welding lines 46 and 47.

Figure 5:
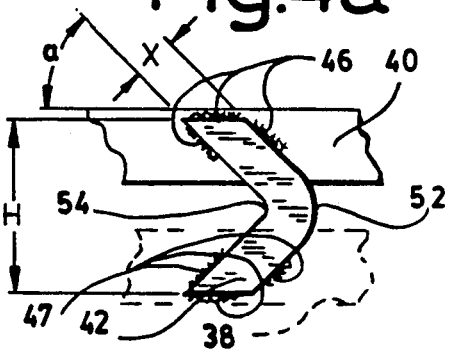
FIG. 5 is a cross-sectional view of a spacing leg along line 5—5 of FIG. 4.

FIG. 5 shows a front view of a spacing leg 42. The leg 42 is generally formed of a substantially V-shaped blade of stainless steel about 0.1 of an inch thick. The width X of the leg 42 is about 0.5 to 1.5 inch, the outer radius of curvature 52 about 0.75 to 1.5 inch, the inner radius of curvature 54 about 0.25 to 0.5 inch and the angle $\alpha$ between both sections of the leg 42 approximately 90 degrees. The vertical dimension H varies depending on the requirements of the installation and usually the thickness of the asphalt to be poured.

Figure 4A:
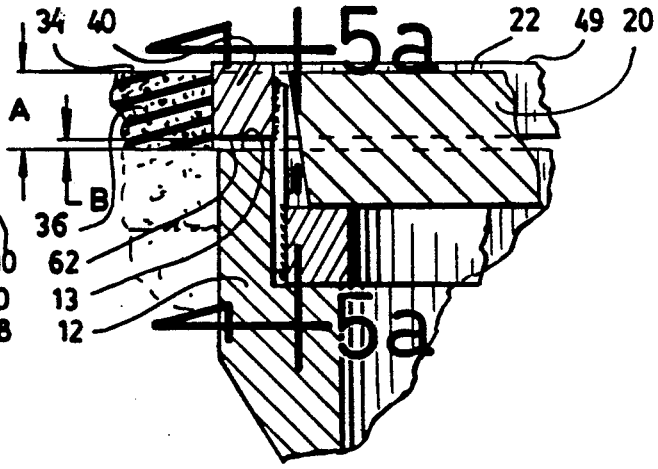
FIG. 4*a* is a view of FIG. 4 prior to the compacting operation.

FIG. 4*a* illustrates the relative positioning of the top ring 40 and the base ring 38 during installation of the raising structure 32 prior to compacting of the new layer of asphalt 36.

As can be seen, the top surface 22 of cover 20 is substantially level with the top surface 34 of the new layer of asphalt 36. The vertical dimension H (FIG. 5) of the spacing legs 42 is such that the top surface 49 of the top ring 40 exceeds the top surface 34 of the new layer of asphalt 36 and there exists an initial clearance B between the bottom surface 62 of the top ring 40 and the top surface 13 of the supporting frame 12.

Figure 5A:
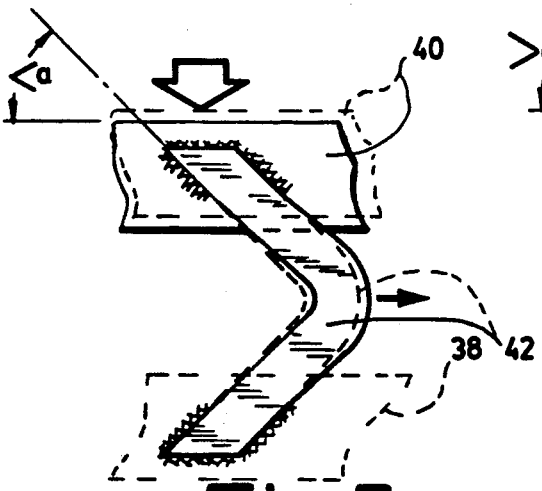
FIG. 5*a–b* is a cross-sectional view of a spacing leg along line 5*a*—5*a* of FIG. 4*a* illustrating the relative displacement of the components during the compacting operation.

When the compacting roller passes over the top ring 40, the legs 42 are adapted to bend about a weak section as illustrated in FIG. 5*a* about the radii of curvature 52 and 54 in a plane substantially tangential to the outer periphery of the top ring 40 at the welding lines 46.

FIG. 4 illustrates the situation after passage of the compacting roller. As can be seen in FIG. 5*a*, the legs 42 will bend until the top surface 64 of the top ring 40 is level with the top surface 34 of the new layer of asphalt 36 and the top surface 22 of the cover. The initial clearance B allows vertical movement of the top ring 40 during the compacting operation.

The type of stainless steel used to manufacture the legs 42, namely 304 stainless steel with a high percentage of nickel, insures that the legs are flexible enough to deform without breaking and without resiliency which would bring back the top ring 40 to its original level.

The major advantage of the present invention is that the legs 42 will invariably bend about the radius of curvature 54 in a plane substantially parallel to the tangent at the welding lines 46 and 47 to the circumferance of the top ring 40. Since the previous structures did not provide legs with a predetermined weak section, the previously known legs were bending randomly and sometimes sideways. The area between the inner diameter of the top ring 40 and the outer diameter of the cover being relatively small, the legs according to the prior art would sometimes abut against the cover and jam it in place. Furthermore, the sideway bending of the legs could sometimes cause horizontal movement of the top ring thus creating a vertical misalignement of the top and base rings.

Figure 4B:
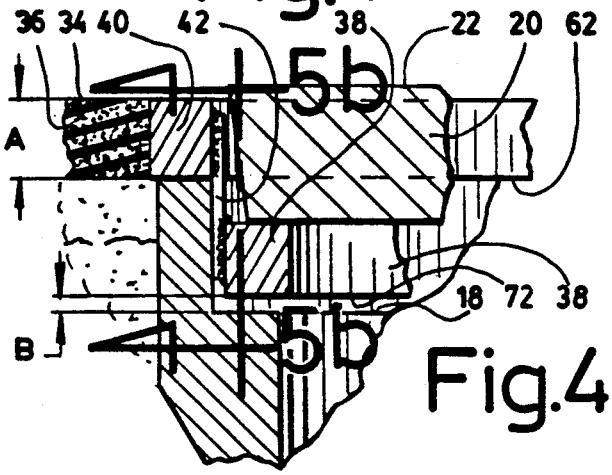
FIG. 4*b* is a view similar to FIG. 4*a* but illustrating an alternative positioning of the rings of the invention.
Figure 5B:
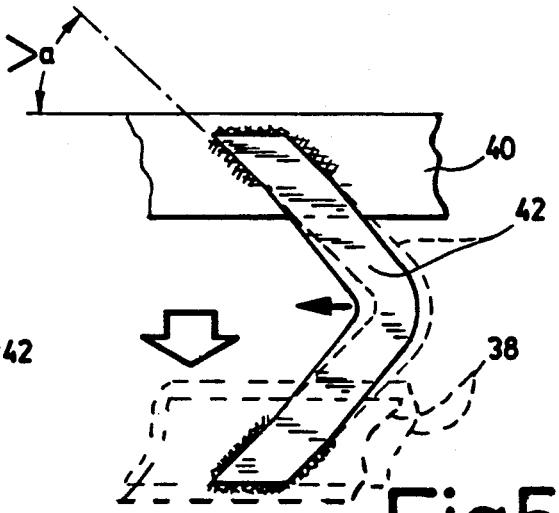
Figure 6:
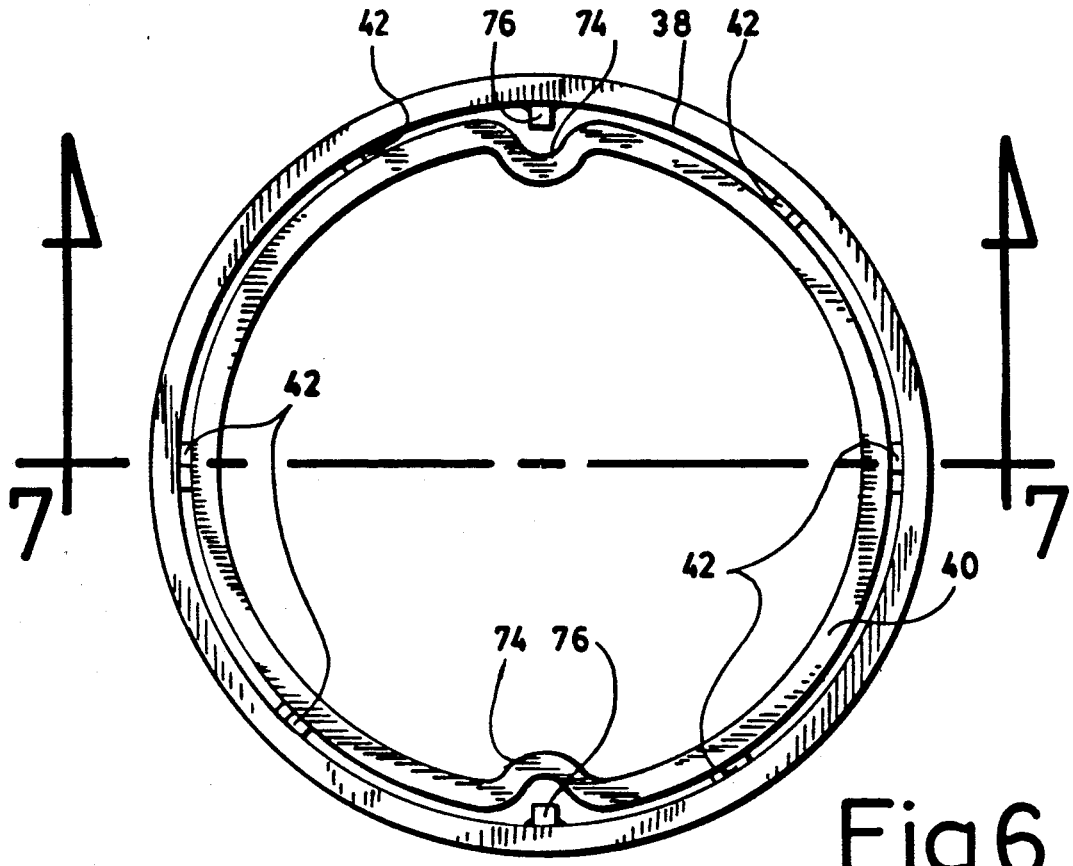
FIG. 6 is a top view of the structure according to the invention.

FIG. 4*b* illustrates an alternative embodiment of the invention whereby the initial clearance is located between the bottom surface 72 of the base ring 38 and the annular recess 18 of the frame 12. In this embodiment, the top ring 40 is initially level with the top surface 34 of the new layer of asphalt 36. The top surface 22 of cover 20 exceeds the level of surface 34 so that when the compacting roller passes over the cover 20 it will push on the base ring 38 on which it rests thus stretching the legs 42 as illustrated in FIG. 5*b*.

As illustrated in FIGS. 6, 7, 8 and 9 the top rings 40 in both embodiments is provided with a pair of indentations 74, while the bottom ring 38 is provided with a pair of prongs 76. The indentation 74 and the prongs 76 are adapted to prevent relative rotation of the rings.

Although the legs 42 have been described as having only one angular or bent section, it is within the embodiment of the invention to provide the leg 42 with more than one angular section such as zigzag, flexuous and senious shapes.

In the preferred embodiment described, a V-shaped wide shade is contemplated. A chevron type of leg consisting of a plurality of narrower blades is also suitable for the purpose of the invention.

I claim:

1. A raising structure for manhole cover comprising a pair of superposed concentric rings, the outer diameter of one of said rings being slightly smaller than the inner diameter of the other ring, a set of spacer legs disposed around the periphery of said one ring and adapted to maintain said rings in spaced relationship, each of said legs having one end secured to the outer periphery of the smaller ring and another end secured to the inner periphery of the larger ring, said legs being characterized by a tilted V-shaped having a bent section between two end sections, said end sections being respectively secured to said rings at locations vertically one above the other, said bent section extending in a plane tangent to the outer periphery of the smaller ring and the inner peripehry of the larger ring, said bent section adapted to define a weak section in the legs for allowing a change in the angle of the bend upon pressure on one of the rings while maintaining both of said end sections vertically aligned with one another.

2. A raising structure for manhole cover as recited in claim 1, wherein said V-shape defines an angle of about 90 degrees.

3. A raising structure for manhole cover as recited in claim 2, wherein each leg is a blade of stainless steel of about 0.1 inch thick, having a width of about 0.5 to 1.5 inch.

4. A raising structure for manhole cover as recited in claim 3, wherein the apex of the angle has an outer radius of about 0.75 to 1.5 inch and inner radius of about 0.25 to 0.5 inch.

5. A raising structure for manhole cover as recited in claim 4, wherein the end sections of the legs are welded to the rings.

* * * * *